United States Patent [19]

Kenway

[11] Patent Number: 4,673,780

[45] Date of Patent: Jun. 16, 1987

[54] SEALED RECTANGULAR PUSHBUTTON SWITCH

[75] Inventor: Sidney Kenway, Fountain Valley, Calif.

[73] Assignee: Eaton Corporation, Cleveland, Ohio

[21] Appl. No.: 827,998

[22] Filed: Feb. 10, 1986

[51] Int. Cl.[4] ..... H01H 13/06
[52] U.S. Cl. ..... 200/302.2
[58] Field of Search ..... 200/302.2

[56] References Cited

U.S. PATENT DOCUMENTS

| | | | |
|---|---|---|---|
| 2,899,516 | 8/1959 | Smith | 200/81 R |
| 3,317,698 | 5/1967 | Mansfield | 200/333 |
| 3,586,811 | 6/1971 | Amis, Jr. et al. | 200/302.2 |
| 3,767,022 | 10/1973 | Olson | 200/302.2 |
| 3,876,851 | 4/1975 | McMains et al. | 200/302.2 |
| 3,928,742 | 12/1975 | Rule | 200/302.3 |
| 4,540,864 | 9/1985 | Krasser et al. | 200/302.2 |

FOREIGN PATENT DOCUMENTS

| | | | |
|---|---|---|---|
| 783141 | 4/1968 | Canada | 200/302.2 |

OTHER PUBLICATIONS

Jay-El Products, Inc., Box 25, 1859 W. 169th St. Gardena, Calif. 90247; "Short Form Catalog—1974"; Unnumbered Page Showing, Integral Splashproof Seal Per Mil Std 108.

Electronic/Electrical Product News, Apr. 1985; Inside of Cover Sheet, "Sealed Illuminated Pushbuttons".

*Primary Examiner*—Stephen Marcus
*Assistant Examiner*—Renee S. Luebke
*Attorney, Agent, or Firm*—D. A. Rowe; L. G. Vande Zande

[57] ABSTRACT

A pushbutton switch having a rectangular opening in a forward end of its housing substantially filled by a single rectangular pushbutton has a rectangular resilient seal attached to the housing at the forward end, the seal further having cylindrical shape disposed within the rectangular shape attached to a cylindrical surface at the rear of the pushbutton, the rectangular and cylindrical shapes being joined together by a reflex bend to provide a rolling movement of the seal upon depresion of the pushbutton.

8 Claims, 8 Drawing Figures

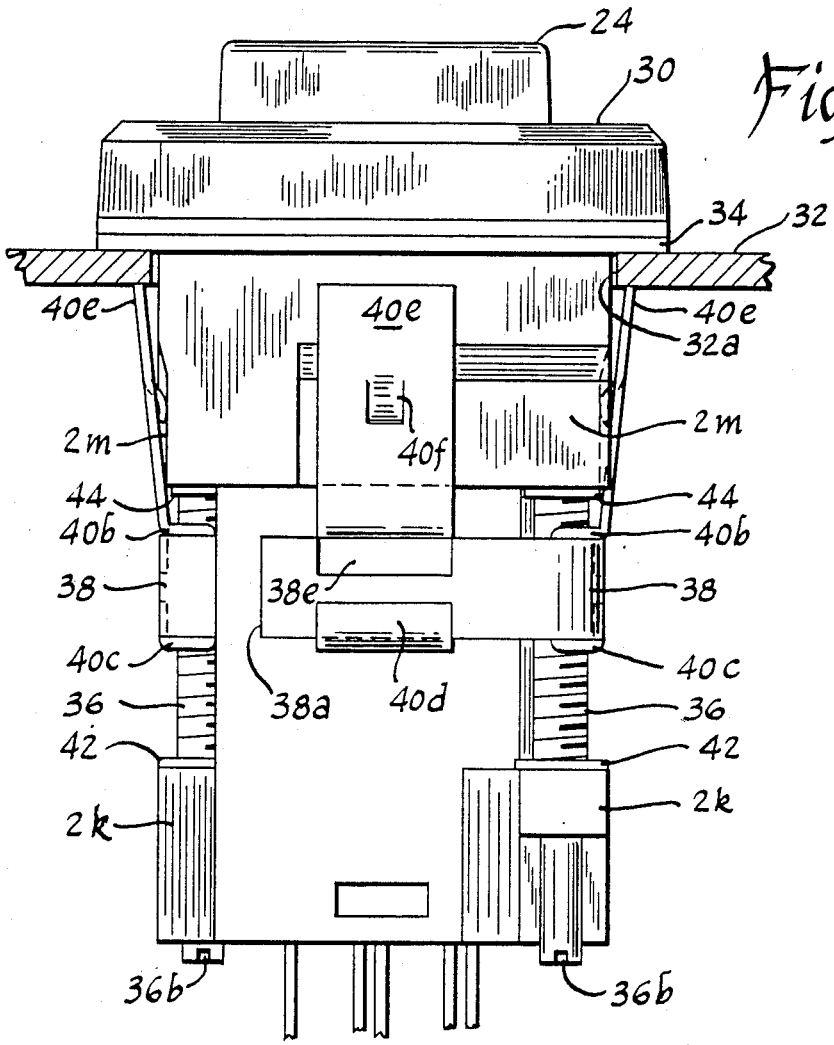
Fig. 5
Fig. 6
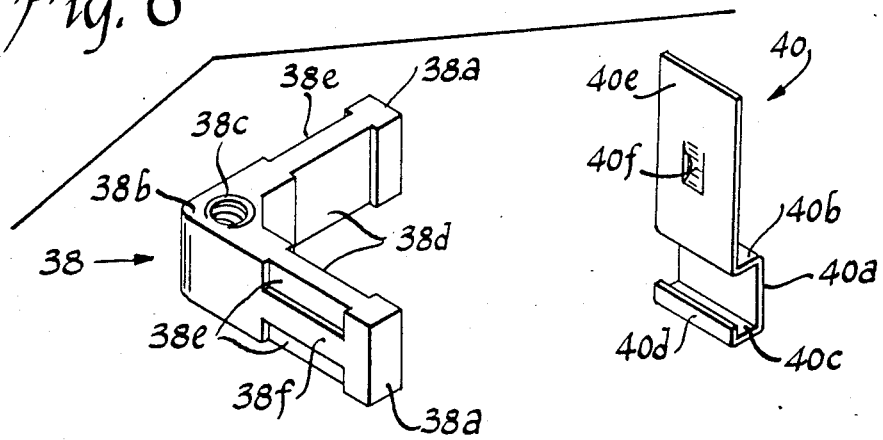

Fig. 7
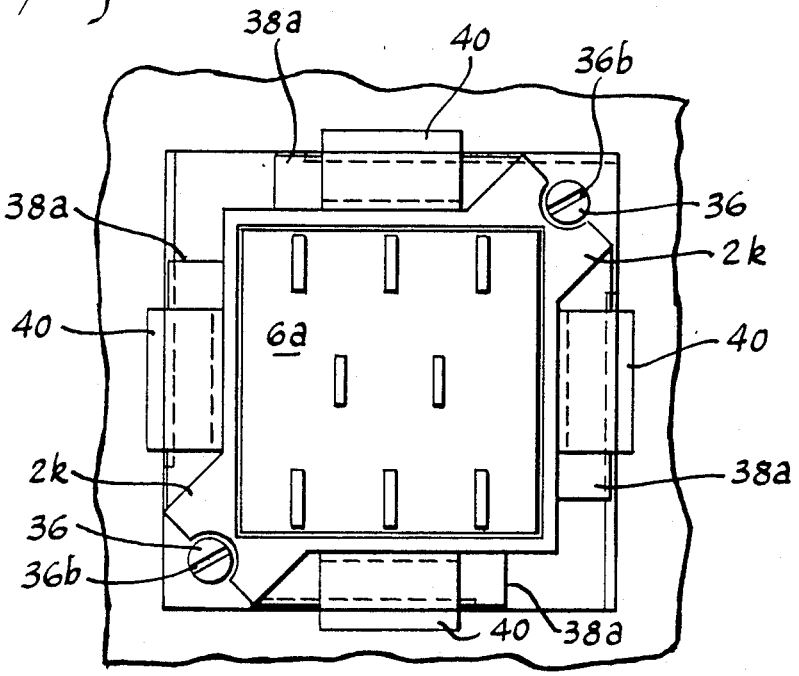
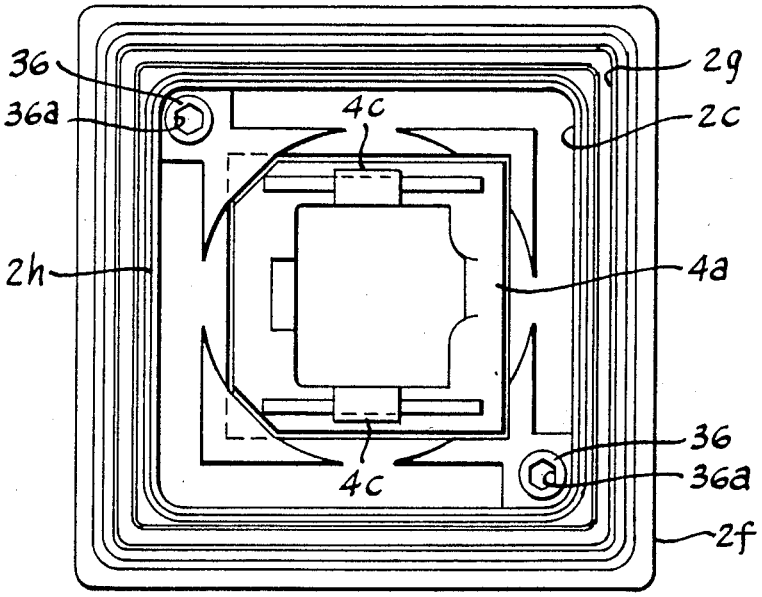
Fig. 8

SEALED RECTANGULAR PUSHBUTTON SWITCH

CROSS-REFERENCE TO RELATED APPLICATION

This application is related to copending application, Ser. No. 827,997, entitled "Panel Mounted Apparatus With Front Operated Clamping Means" filed concurrently herewith in the name of Sidney Kenway and assigned to the assignee of this application.

BACKGROUND OF THE INVENTION

This invention relates to pushbutton operated devices such as electrical switches or the like wherein the pushbutton and surrounding portion of the housing have a rectangular shape as viewed from the front and a fluid or dust tight seal is provided between the pushbutton and housing. When the transverse space between pushbutton and housing is small and the linear stroke of the pushbutton is relatively large, it is difficult to provide a flexible sealing element which will seal effectively at the corners of the rectangular elements while permitting the necessary linear movement or depression of the pushbutton.

SUMMARY OF THE INVENTION

This invention provides a seal between a housing having a rectangular aperture and a rectangularly shaped operator movably disposed within the aperture, the seal being rectangular in shape to conform with the housing and having a cylindrical center portion engaging with a cylindrical sealing surface at the rear of the pushbutton for providing an enhanced sealing surface while permitting linear movement of the rectangular pushbutton. In a preferred embodiment, the cylindrical center portion and rectangular portion of the seal are joined by a reflex bend to permit rolling movement of the seal at points where the center portion is tangential to said rectangular portion.

The invention, its advantages and features will be more readily understood when reading the following specification and claims in conjunction with the accompanying drawings.

BRIEF DESCRIPTION OF THE DRAWINGS

FIG. 5 is a side elevational view of the pushbutton switch of this invention showing that switch clamped to a panel by means of a clamping structure provided on the switch;

FIG. 6 is an exploded isometric view of one nut and one clamping strap of the clamping structure for the switch of this invention;

FIG. 7 is a bottom plan view of the switch as shown in FIG. 5; and

FIG. 8 is a top plan view of the switch of this invention with the flexible seal, actuator extension, operator cap and bezel removed.

DESCRIPTION OF THE PREFERRED EMBODIMENTS

The device of this invention comprises a pushbutton switch having a hollow rectangular housing 2 for receiving a molded actuator 4 and a molded switch base 6 therein. The transverse profile of the switch is essentially square as may be seen in FIGS. 7 and 8. The switch is a double pole device having a contact switching mechanism 10 located along opposite side walls of the housing. The center portion of the switch is essentially open and may contain a lamp structure if desired to provide an illuminated switch.

Figure 1:
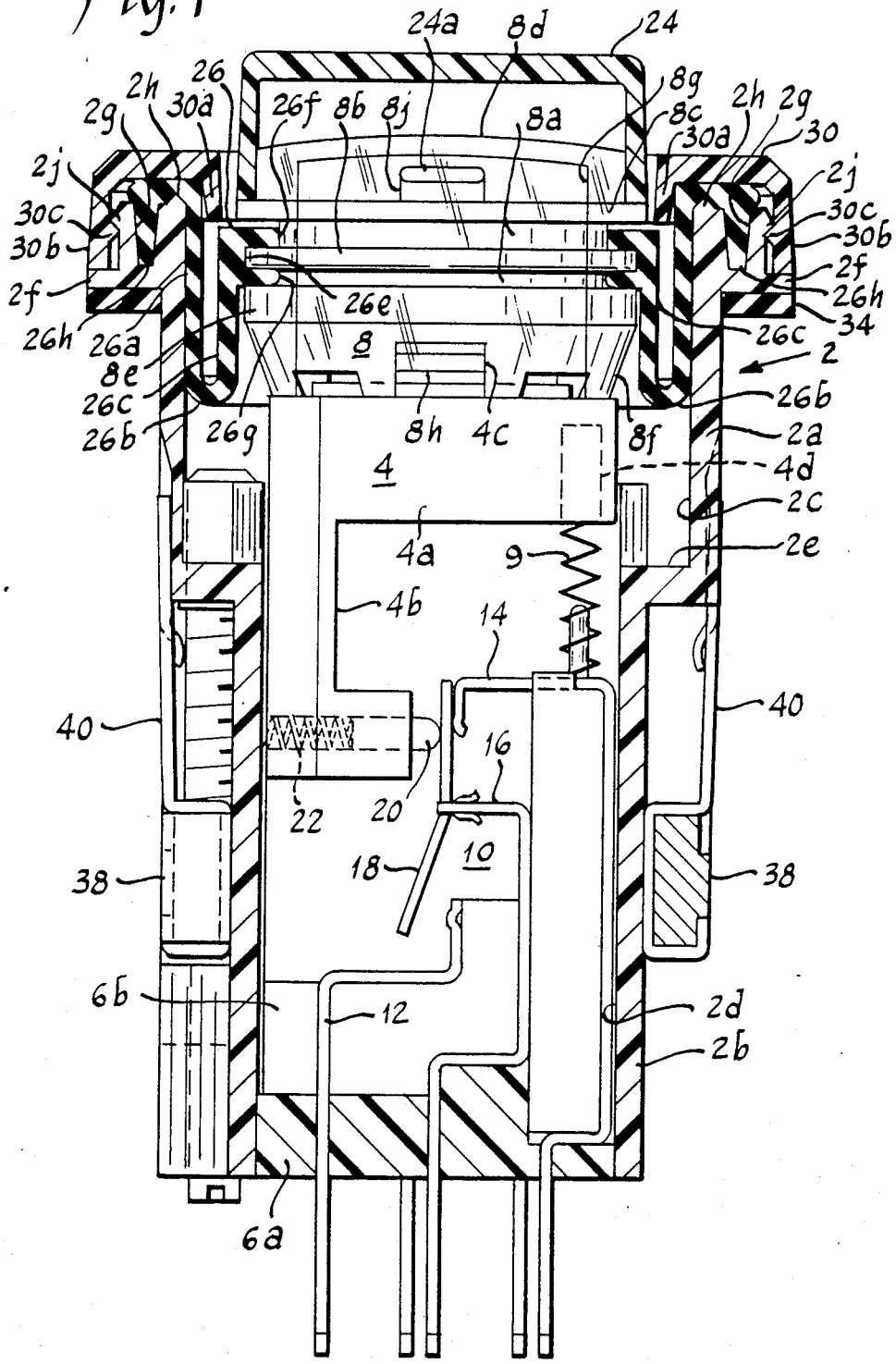
FIG. 1 is a longitudinal cross sectional view of a pushbutton switch constructed in accordance with this invention.

Actuator 4 comprises a molded platform **4*a* which is essentially square in a transverse plane of the switch and has a pair of contact actuator legs 4*b* (only one of which is shown in the drawings) projecting downwardly at diagonally opposite corners thereof. Actuator 4 has a pair of upstanding hooks 4*c* molded integrally with the upper surface of platform 4*a* for providing snap-fit attachment with an actuator extension member 8. The underside of platform 4*a* has a pair of diagonally located cylindrical recesses or blind holes 4*d* (only one of which is shown in FIG. 1) which are open to the under side of the platform 4*a* for receiving helical springs 9 therein. Springs 9 rest upon the upper surface of base 6 to bias actuator 4** upwardly as viewed in the drawings toward a forward end of the switch.

The base 6 is a two-part assembly having a molded header **6*a* and a molded terminal block 6*b* which may be snap-fit together or be secured together by an adhesive or the like. The opposed lateral surfaces of support block 6*b* are configured to receive and mount the stationary contact-terminal members 12 and 14 and movable contact support-terminal member 16 in the positions shown in FIGS. 1 and 2. A rocking contactor 18 is pivotally supported upon the end of stationary support-terminal member 16 for alternate rocking engagement with stationary contacts 12 and 14. A spring biased plunger 20 is carried within a cylindrical hole in the lower portion of the respective actuator leg 4*b* and is biased by a spring 22 into engagement with the surface of rocking contactor 18. Translation of the plunger 20 across the plane of support terminal member 16 in response to linear reciprocal movement of actuator 4 causes contactor 18 to rock from the position shown in FIG. 1 wherein it electrically bridges stationary contact 14 and center support terminal 16 to the position shown in FIG. 2 wherein it electrically bridges stationary contact 12 with center support terminal 16**. The switch is similar to that shown and claimed in U.S. Pat. No. 4,383,149 issued May 10, 1983 to Edward Fulton and assigned to the assignee of this application, which patent is incorporated herein by reference and which may be referred to for additional details of the switch.

Actuator extension 8 is a transition member which provides a cylindrical sealing surface **8*a* between a rectangular pushbutton cap 24 and the rectangular actuator platform 4*a*. Cylindrical sealing surface 8*a* has a raised annular rib 8*b* thereon. At the forward end of cylindrical surface 8*a*, extension 8 comprises a rectangular platform 8*c* which has an upstanding domed lens portion 8*d*, the transverse profile of lens portion 8*d* also being rectangular. The rear of innermost end of extension 8 comprises an enlarged cylindrical section 8*e* essentially the same diameter as raised annular rib 8b and a frustoconical section joining cylindrical section 8e to a reduced diameter which is essentially equal to the transverse dimensions of rectangular platform 4a. Extension 8 is provided with a cylindrical recess 8g open to the rear end thereof and is preferably formed of a transparent material to serve as a light transmitting lens member if the switch is to incorporate a lamp in the open central cavity. The surface of recess 8g is provided with notches 8h at diametrically opposed points which cooperatively engage with the upstanding tabs 4c to connect the extension 8 to the actuator 4 with a snap fit. The exterior surface of lens portion 8d is provided with recesses 8j for receiving projections 24a formed on interior surfaces of pushbutton cap 24 to thereby attach cap 24 to extension 8** with a snap fit.

Molded insulating housing 2 comprises a forward portion 2a having a rectangular, essentially square transverse profile of a first dimension and a rear end portion 2b having a rectangular, essentially square transverse profile of a second, reduced dimension with respect to the forward portion 2a, the two portions joining at a transverse shoulder 2e intermediate the ends of the insulating housing. Front portion 2a has a rectangular cavity 2c and rear portion 2b has a rectangular cavity 2d. The forward end of housing 2 is enlarged with respect to the transverse profile of forward section 2a and comprises an outwardly projecting flange 2f and a groove 2g which is open to the forward end of the housing and extends around the periphery of cavity opening 2c. A triangular shaped raised rib 2h extends peripherally around the opening 2c at the forward surface of the housing between the opening 2c and the groove 2g. Lateral surfaces of the forward end of housing 2 are provided with latching surfaces 2j for attaching a bezel 30 as will be described hereinafter.

Figure 4:
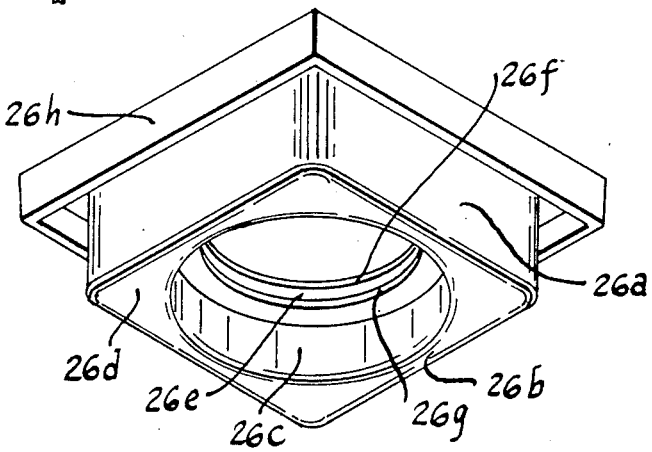
FIG. 4 is an isometric view of the flexible seal viewed from the rear.
Figure 3:
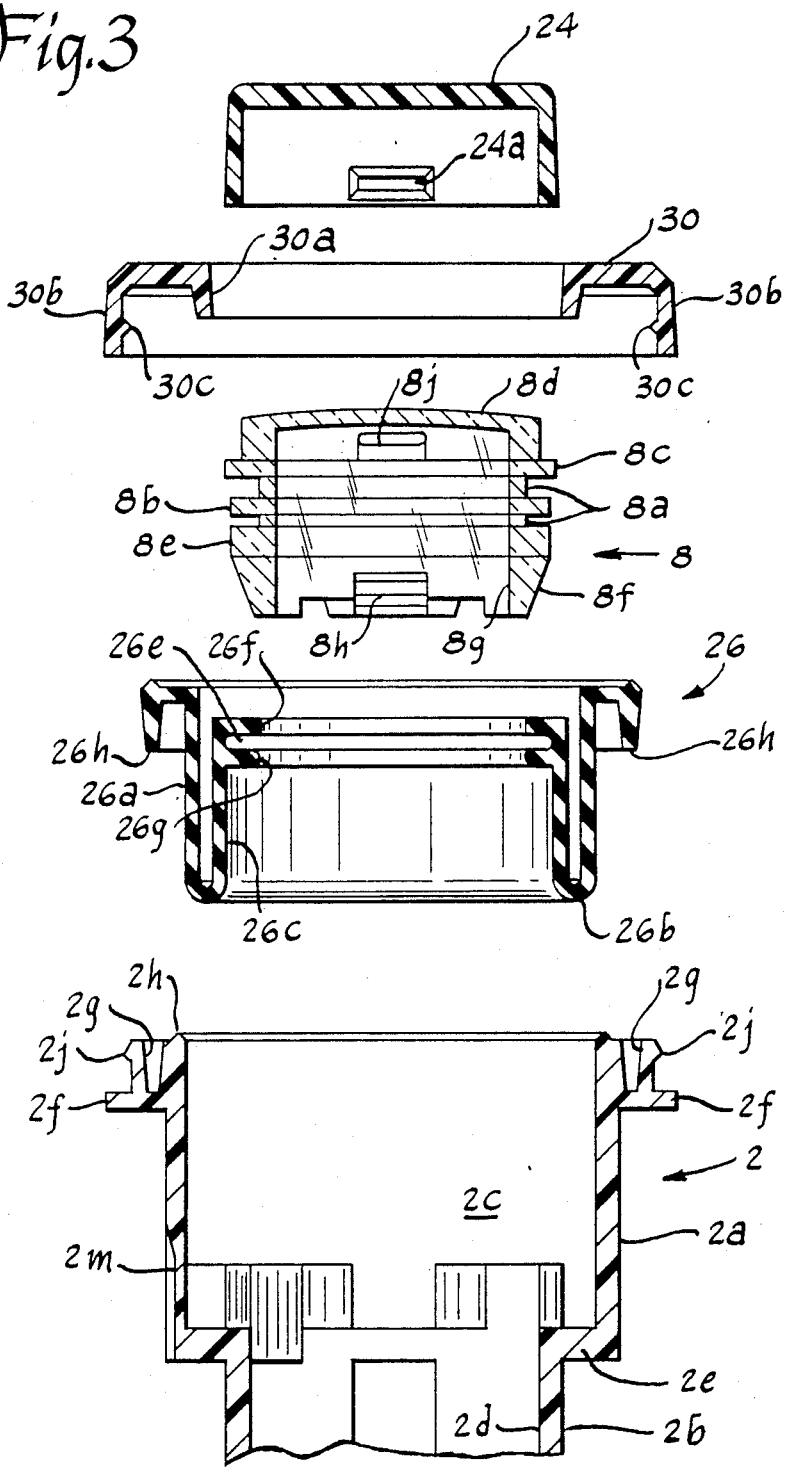
FIG. 3 is an exploded view in cross section of a forward portion of the housing of the Switch of FIGS. 1 and 2, a formed flexible seal, an actuator extension member, a bezel and a pushbutton cap.

A flexible seal 26 is provided between housing 2 and the elements comprising the depressible pushbutton operator. Seal 26 has a rectangular body portion 26a which closely conforms to the interior walls of housing 2 defining rectangular cavity 2c. The rearmost end of seal 26 is formed with a reflex bend 26b which joins to a cylindrical portion 26c which is centrally disposed within the rectangular body portion 26a. With reference also to FIG. 4, the reflex bend 26b is semicircular at the points where cylindrical portion 26c is tangential to rectangular body portion 26a. In the areas between these tangential points, the reflex bend is defined by a continuation of the radius of the semicircular section on both the rectangular and the cylindrical surfaces which are joined by short transverse areas which define a rear surface 26d. The forward end of cylindrical portion 26c terminates in a collar of increased thickness having an annular groove 26e which defines a pair of axially spaced circular openings 26f and 26g. The forward end of cylindrical portion 26c is stretched over the cylindrical sealing surface 8a of extension 8 such that the circular openings 26f and 26g engage the cylindrical sealing surface 8a on opposite sides of the raised annular rib 8b, the latter being received within the groove 26e. The circular openings 26f and 26g are made slightly smaller than the diameter of the cylindrical sealing surface 8a so that in the assembled position the seal is stretched snuggly over the sealing surface to form a good seal therewith which is devoid of corners associated with rectangular structures. The spaced circular openings 26f and 26g, the raised rib 8b and the groove 26e form a labyrinth to further enhance the sealing structure.

The forward end of rectangular body 26a of seal 26 overlies the forward end of the housing 2. In the preferred embodiment, the forward end of seal 26 includes a rearwardly extending skirt 26h which is peripherally spaced from body portion 26a. Skirt 26h is received within groove 2g of housing 2. A rectangular shaped bezel 30 of molded insulating material and having a rectangular central opening, is attached over the forward end of the switch housing 2 and the forward end of seal 26. Bezel 30 has a rearwardly extending inner wall 30a around the periphery of the central rectangular opening and a rearwardly extending outer peripheral wall 30b. The interior of outer wall 30b is provided with a plurality of projections 30c which cooperate with latching surfaces 2j on housing 2 to attach the bezel to the housing with a snap fit. When so attached, bezel 30 is pulled snuggly down upon the front surface of the seal 26, thereby elastically deforming the seal over the triangular raised rib 2h to enhance the sealed juncture between seal 26 and housing 2.

The reflex bend 26b joining rectangular body 26a and cylindrical portion 26c enables the seal to roll rearwardly in a small confined area when the actuator 4 is linearly moved rearwardly by depression of pushbutton operator cap 24. The semicircular bends 26b at the tangential points of cylindrical portion 26c to rectangular portion 26a truly roll along the interior surface of cavity 2c, whereas the areas between the tangential points which define rear surface 26d of the seal roll along the cylindrical portion but deflect along the rectangular portion.

The switch is adapted to be mounted in a sealed manner to a panel 32 which has a rectangular opening 32a conforming to the transverse profile of the forward end 2a of housing 2. As seen in FIG. 5, the housing 2 is inserted through the opening 32a in panel 32 from the front of the panel (shown as the top of the panel in FIG. 5). A gasket 34 is disposed over the forward end 2a of housing 2 under the flange 2f of the forward end of housing 2, and the gasket and flange abut the forward surface of panel 32 along the periphery of the opening 32a. Referring also to FIG. 8, switch housing 2 has a pair of screws 36 journaled for rotation in diagonally opposite corners of the rectangular cavity 2c. The screws 36 project through the transverse shoulder 2e joining forward portion 2a and rear portion 2b of housing 2 to extend rearwardly along the exterior of rear portion 2b at diagonally opposed corners thereof. As seen best in FIGS. 5 and 7, rear housing portion 2b has a pair of bearing blocks 2k molded integrally with the housing at diagonally opposed corners for rotatably journaling the rear ends of screws 36.

Each of the screws 36 receives a clamping assembly comprising a V-shaped nut 38 and a pair of clamping straps 40. The nuts 38 are preferably die cast aluminum members having a pair of arms 38a joined at right angles at an apex or hub 38b. A threaded hole 38c is provided through the apex or hub 38b. The outer ends of the arms 38a have shallow relief channels 38d formed on the interior surfaces and a pair of recesses 38e formed on the outer surfaces opposite the channel 38d. The recesses 38e are formed only part way into the respective arms from the upper and lower surfaces thereof leaving a web of material 38f therebetween. The clamping straps 40 comprise a resilient spring material, one end of which is formed into a hook shape to be secured over a respective arm 38a of nut 38. The hook shaped end of clamping strap 40 comprises a C-shaped channel having a vertical wall 40*a* and opposed upper and lower transverse walls 40*b* and 40*c*, respectively. The outer end of lower wall 40*c* is turned vertically upwardly essentially parallel with wall 40*a*. The other end of upper wall 40*b* is similarly turned upwardly to form a vertically extending leg 40*e* which extends substantially parallel to wall 40*a*. Leg 40*e* is provided with a sheered offset cam surface 40*f* for purposes that will be described hereinafter. The straps 40 are attached to the respective arms 38*a* of nuts 38 by hooking a leg 40*d* within a respective recess 38*e* such that leg 40*a* is disposed within an adjacent channel 38*d*. Leg 40*b* is deflected slightly to enable it to be inserted over the top surface of the respective leg 38*a* to securely lock the strap 40 to the nut 38.

The clamping assemblies are provided at the respective diagonally opposed corners of rear portion 2*b* of switch housing 2 and screws 36 are threadably inserted into the openings 38*c* of the nuts 38. The rearmost ends of screws 36 have a reduced diameter which is rotatably supported within the bearing block portion 2*k* of housing 2. A washer 42 is disposed over the reduced diameter end of screw 36 to rest upon a forward surface of bearing block 2*k*. A C-shaped snap ring 44 is inserted into a groove (not shown) in the respective screws 36 adjacent transverse shoulder 26 to cooperate with the washers 42 in fixing the forward and rearward movement of screws 36 with respect to the housing 2. The arms 38*a* of nuts 38 are disposed along a pair of adjacent sides of rear end housing portion 2*b* to slide along the flat surface thereof and prevent rotation of the nut 38 with respect to the housing. The length of arms 38*a* and the position of recesses 38*d* and 38*e* to define the position of straps 40 is predetermined to place each strap 40 at the midpoint of each respective side of the housing. The screws 36 are provided with recessed hexagonal openings 36*a* at their forward ends for engagement by a hexigonally shaped drive tool such as an Allen wrench or the like, and are provided with slots 36*b* at the rear ends for engagement with a flat bladed screwdriver or similar tool. Rotation of the screws 36 from either end causes the nuts 38 to move longitudinally along the housing portion 2*b* in either the forward or rearward direction according to the respective rotation.

Figure 2:
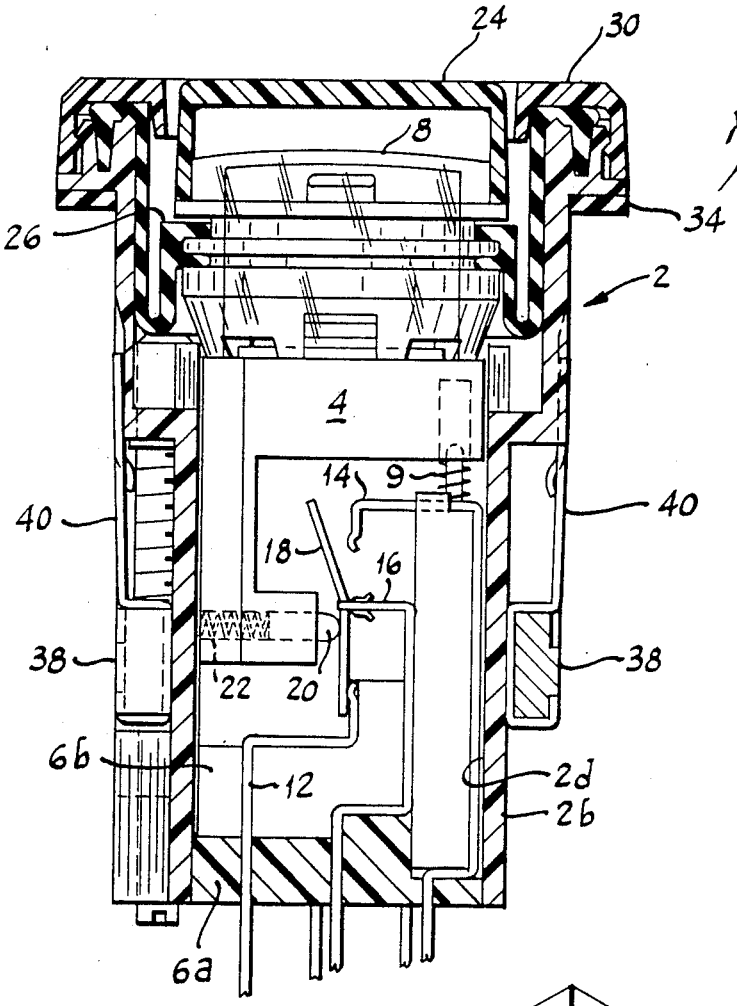
FIG. 2 is a view similar to FIG. 1 drawn to a reduced scale and showing the pushbutton operator of the switch moved to a depressed position.

The exterior surface of forward end 2*a* of housing 2 is provided with a recess 2*m* on each of the respective sides thereof. As seen in FIGS. 1 and 2, when the nuts 38 are in their rearwardmost position adjacent the forward surfaces of bearing blocks 2*k*, the forward ends of legs 40*e* of the straps 40 are received within the recess 2*m* such that the straps 40 are flush with the exterior surface of housing portion 2*a*. In that position, the straps 40 provide no interference with insertion or removal of the housing 2 from the panel 32. When the housing is inserted within the opening 32*k* of the panel, it is desired to attach the housing thereto, access to the screws 36 may be had by removing the bezel 30, seal 26, and extension 8 from the forward end of the switch. Then using the proper tool, the screws 36 may be rotated to cause nuts 38 to move forwardly along the housing. Such movement causes cam surfaces 40*f* to engage the transverse shoulder 2*e* of the housing 2 to cam the forward ends of legs 40*e* of straps 40 laterally outwardly of the housing to engage the rear surface of panel 32 adjacent the opening 32*a*. The switch may be tightly clamped against the panel by the desired amount of pressure applied to the rotation of screws 36. Clamping pressure from a respective screw 36 is applied to two of the four sides of the switch device at the midpoint of each of the sides and is uniformly distributed to these two sides. By applying a uniform rotational force to the two screws, a uniform clamping force can be provided at four sides of the switch to provide good sealing engagement between the flange 2*f* and the panel 32 by virtue of the gasket 34. With the switch housing in place on the panel, the extension 8 and seal 26 may be reassembled over the open forward end of the switch and secured thereto by snapping bezel 30 over the seal 26 to the lateral walls of the forward end of housing 2.

Thus the foregoing has described a preferred embodiment of a rectangularly shaped pushbutton device which provides an improved sealed juncture between the movable pushbutton element and the fixed housing. It is to be understood that the invention is capable of various modifications without departing from the scope of the appended claims.

I claim:

1. A pushbutton switch comprising, in combination:

a housing having a rectangular opening in a forward end thereof defined by interior surfaces of housing sidewalls;

switch contacts mounted within said housing;

operating means mounted for linear reciprocal movement in said housing for operating said switch contacts, said operating means comprising a single rectangular pushbutton disposed within said substantially filling said rectangular opening, said pushbutton being depressible inwardly of said housing, a cylindrical sealing surface disposed rearwardly of said rectangular pushbutton and having its axis aligned with said linear reciprocal movement, and a raised annular rib on said cylindrical sealing surface; and a resilient seal disposed over said forward end of said housing, said seal comprising a tubular rectangular body having sidewalls extending inwardly into said rectangular opening along said interior surfaces of said housing sidewalls substantially beyond said cylindrical sealing surface, a cylindrical portion centrally disposed within said rectangular body having its axis aligned with said linear reciprocal movement, a forward end of said cylindrical portion comprising a pair of axially spaced circular openings for engaging said cylindrical sealing surface on opposite sides of said annular rib for attachment to said operating means, a rear end of said cylindrical portion and a rear end of said rectangular body joined together by a reflex bend which is semicircular at points where said cylindrical portion is tangential to said rectangular body and comprises flat transverse wall sections at corners of said rectangular body between said tangential points, said flat wall sections joining said cylindrical portion and said rectangular portion by radiused portions which are continuations of said semicircular shape, said cylindrical portion translating rearwardly upon depression of said pushbutton causing said semicircular reflex bend to roll rearwardly along said interior surfaces of said housing sidewalls at said tengential points and causing said radiused portion adjacent said cylindrical portion to roll rearwardly with respect to said flat wall sections between said tangential points.

2. The invention defined in claim 1 further comprising a bezel overlying said seal and said housing at said forward end of said housing, said bezel having a rectangular opening for said pushbutton and being attached to said housing for compressing said seal against a forward surface of said housing.

3. The invention defined in claim 2 wherein said forward surface of said housing comprises an upstanding rib along a periphery of said rectangular opening in said housing, said seal being compressed over said upstanding rib.

4. The invention defined in claim 2 wherein said forward surface of said housing comprises a groove peripherally spaced around said rectangular opening and said seal comprises an outwardly extending flange overlying said forward surface and a skirt depending rearwardly from said flange into said peripherally spaced groove.

5. The invention defined in claim 4 wherein said bezel comprises a rearwardly extending peripheral wall overlapping said forward end of said housing along a lateral wall thereof, and said peripheral wall is provided with means on its inner surface cooperable with means provided on said lateral wall for effecting snap-on attachment of said bezel to said housing.

6. The invention defined in claim 5 wherein said bezel comprises a second rearwardly extending wall along the periphery of said bezel rectangular opening, said second rearwardly extending wall overlying a forward end of said seal rectangular body for retaining said rectangular body sidewalls firmly engaged with said interior surfaces of said housing sidewalls when said outwardly extending flange of said seal is compressed against said housing forward surface by said bezel.

7. The invention defined in claim 6 wherein said housing forward surface comprises a continuous raised rib disposed between said peripherally spaced groove and said rectangular opening in said housing.

8. The invention defined in claim 1 wherein said pair of axially spaced circular openings have diameters which are respectively less than corresponding diameters of said cylindrical sealing surface, said spaced circular openings being elastically enlarged by engagement with said cylindrical sealing surface to provide a fluid-tight joint between said seal and said operating means.

* * * * *